United States Patent [19]

Baughman et al.

[11] Patent Number: 4,828,520

[45] Date of Patent: May 9, 1989

[54] MODULAR LIFERAFT

[75] Inventors: Joseph W. Baughman, Summersville; Arden D. Bayless, Craigsville, both of W. Va.

[73] Assignee: The B.F. Goodrich Company, Akron, Ohio

[21] Appl. No.: 120,582

[22] Filed: Oct. 7, 1987

Related U.S. Application Data

[63] Continuation of Ser. No. 4,357, Jan. 16, 1987, abandoned.

[51] Int. Cl.[4] ..... B63B 35/58

[52] U.S. Cl. ..... 441/40; 441/37; 441/38; 441/39; 114/345; 114/348

[58] Field of Search ..... 114/345, 346, 348, 349, 114/350, 352, 353, 121; 441/35, 38, 39, 40, 37, 41, 42

[56] References Cited

U.S. PATENT DOCUMENTS

| | | | |
|---|---|---|---|
| 2,914,779 | 12/1959 | Walker | 441/39 |
| 3,034,154 | 5/1962 | Silverstone | 441/38 |
| 3,037,218 | 6/1962 | Brooks, III | 441/38 |
| 3,628,206 | 12/1971 | Mecham | 114/346 X |
| 3,736,607 | 6/1973 | Radnofsky et al. . | |
| 3,883,913 | 5/1975 | Givens . | |
| 4,001,905 | 1/1977 | Givens . | |

FOREIGN PATENT DOCUMENTS

| | | | |
|---|---|---|---|
| 199288 | 11/1983 | Japan | 441/40 |
| 2066193 | 7/1981 | United Kingdom | 441/37 |

*Primary Examiner*—Sherman D. Basinger
*Assistant Examiner*—Paul E. Salmon
*Attorney, Agent, or Firm*—Joseph Januszkiewicz

[57] ABSTRACT

A modular liferaft wherein the canopy, canopy support, floor pads if any, boarding ramp and at least one ballast are detachably attached to a liferaft hull and floor assembly. Modular construction facilitates maintenance and repair and may reduce the cost and volume of materials employed in spares programs necessary to support liferafts used in commerce.

5 Claims, 1 Drawing Sheet

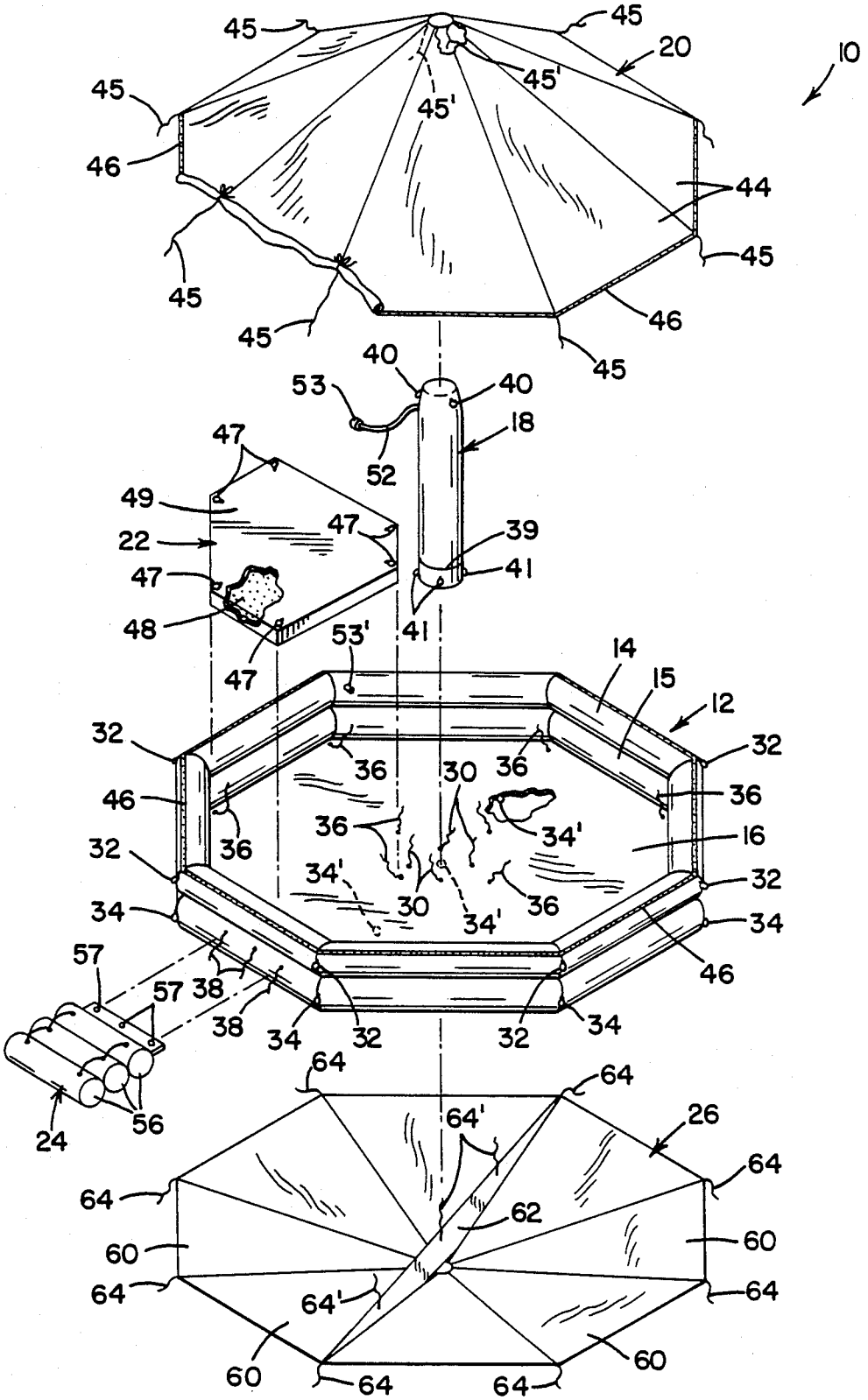
10
20
45
45'
44
46
40
18
53
52
47
49
22
39
41
48
53'
14
15
12
32
36
30
34'
16
34
57
38
56
24
64
64'
26
62
60

MODULAR LIFERAFT

This application is a continuation, of application Ser. No. 004,357, filed 1/16/87 now abandoned.

FIELD OF THE INVENTION

This invention relates to liferafts and more particularly to liferafts configured for use on the high seas and for providing one or more individuals temporary physical support while awaiting rescue upon the high seas. More particularly, this invention relates to liferafts carried aboard vessels and configured for deployment, typically automatic deployment, during an emergency wherein the vessel faces sinking or the imminent threat of sinking.

BACKGROUND OF THE INVENTION

Liferafts for effecting rescue and support of human life on the high seas are well-known. While early liferafts often took the form of a platform formed of lumber, logs or other floatable materials, more recently liferafts have come generally uniformly to be formed from fabric coated on one or both surfaces with a rubberizing compound and formed into a floatation structure. Typically this floatation structure includes one or more circumferential tubes and a floor. The tubes typically are stacked vertically to form a wall of tubes characterized by an uppermost and lowermost tube and the floor typically is cementingly or vulcanizably adhered to the lowermost tube to preclude the entry of water into the liferaft between the floor and the lowermost tube.

While a basic liferaft is thereby defined, and frequently resembles an inflatable children's swimming pool in appearance, these basic liferaft forms do not, unaltered, find extensive use on high seas. In modern society, regulations, legislation, and practice in many countries of the world require such basic rafts to include other features.

Typically today, such liferafts include an insulation means the better to separate occupants of the raft from cold waters surrounding the raft by more than simply a single ply layer of rubberized fabric. So, modern liferafts typically have a double-walled bottom inflated to provide an insulation capability or where liferafts have a single ply bottom, these liferafts will also include a plurality of insulating floor sections that typically include an insulation pad formed of an insulating material such as foam.

Liferafts today may also include a canopy configured to provide a sheltering roof over the raft thereby at least partially protecting occupants of the raft from wind and wave. Typically these canopies include a center support within the raft configured to hold the canopy over the heads of occupants of the raft without the necessity for the occupants jointly raising arms to physically hold the canopy in place above their heads.

Liferafts today may also include an inflatable boarding ramp affixed by vulcanization or cementation to an external surface of the raft, functioning to facilitate boarding from deep, open waters. In addition, liferafts today typically include at least one ballast means. These ballast means tend to lower the center of gravity of the liferaft and thereby reduce a tendency for the liferaft to tip over and/or tumble during conditions of strong waves and high winds.

It is the custom for liferafts to be formed as an integral unit; that is all, or nearly all of the necessary units of the raft subject to deterioration and/or failure have generally been co-attached permanently so that repair of one or more portions of the raft and its accessories can be quite difficult. Often unrepairable damage to one accessory can render the entire liferaft unuseable necessitating replacement. A liferaft in which one of the various components could, upon failure or damage, be removed and replaced while necessary repairs to the component are undertaken, could find substantial utility in commerce.

SUMMARY OF THE INVENTION

The present invention provides a modular liferaft. The modular liferaft of the invention includes a hull and floor assembly which comprises a plurality of generally vertically stacked inflatable tubular members defining an outer periphery of the raft, and a floor attached to a lowermost of the inflatable tubular members to preclude entry of water into the raft between the floor and the lowermost tubular member. This floor may be either double-walled to provide an insulation capability or may be configured to accept floor sections configured to provide an insulation capability. These floor sections in the purview of the invention, are removable. A removable canopy is provided. The removable canopy is supported by a separate removable support strut generally centerably positioned within the hull and floor assembly. The support strut typically is an inflatable structure and typically includes a means for inflating this support strut.

A boarding ramp is provided for removable attachment to the exterior of the hull and floor assembly. Typically this boarding ramp is an inflatable structure.

A ballast means is provided removably attachable to the hull and floor assembly. The ballast means typically includes a pair of chambers defined by a partition within the ballast means.

The canopy and the ballast means are configured for generally peripheral attachment to the hull and floor assembly. The ballast means also may include non-peripheral attachment to the floor such as might be employed to position and support a baffle within the ballast means. The canopy support typically is retained to the hull and floor assembly in removable manner as are the floor sections and the boarding ramp. The canopy typically also is retained in removable manner to the canopy support. Attachment of the canopy, canopy support, floor sections, boarding ramp, and ballast system can be accomplished within the purview of the invention employing reusable fastening means such as snaps, Velcro®, grommets configured to accept ties where the ties are cording, webbing straps, or the like, quarter-turn fasteners, and hooks, including swivel hooks, configured to engage grommets or D-rings.

The detachable portions of the modular liferaft, that is the canopy, canopy support, floor sections if necessary, boarding ramp, and ballast means can be detached from the hull and floor assembly for replacement or repair and the hull and floor assembly can remain in service utilizing replacement accessories during any such necessary service or repair. Further, scrapping of the hull and floor assembly does not necessarily mean scrapping of the accessories, as these may be reused on other raft and hull assemblies.

The above and other features and advantages of the invention will become more apparent when considered in conjunction with a description of a preferred embodiment of the invention together with a drawing which follow comprising a part of the specification.

DESCRIPTION OF THE DRAWINGS

FIG. 1 is an exploded view of a modular liferaft made in accordance with the invention.

BEST EMBODIMENT OF THE INVENTION

Referring to the drawing, a modular liferaft 10 is shown in exploded view. The modular raft 10 includes a hull and floor assembly 12. The hull and floor assembly is comprised of two major elements; one element being a plurality of inflatable tubular members designated in FIG. 1 as an upper inflatable tubular member 14 and a lower inflatable tubular member 15, cooperating with a floor element 16. The upper inflatable tubular member 14 and the power inflatable tubular member 15 are generally positioned vertically one with respect to the next and co-attached typically employing well-known vulcanization or cementation techniques to prevent the passage of water therebetween. The floor 16 and the lower inflatable tubular member 15 are typically co-attached in a similar manner precluding the passage of water therebetween and securing the floor 16 to the tubeless member 15 sufficiently to support loads imposed on the floor by occupants of the modular raft 10. The inflatable tubular members 14, 15 and the floor 16 thereby operate to define a hull and floor assembly 12 or floatation vessel suitable for the containment of chattel goods and human life.

It is important to note that the inflatable tubular members 14, 15 may be compartmentalized and function to circumferentially surround the floor to define an open tub or boat-like basin. It is not necessarily that the inflatable tubular members 14, 15 define a structure having or equal or relatively equal sides, but may instead define a structure of any geometric configuration and proportion having suitable or conventional desired seagoing capabilities.

A canopy support strut 18 is provided A canopy 20 is also provided and is configured to be supported by the canopy support strut 18. A plurality of floor sections 22 are provided of a configuration suitable for being received within the confines of the hull and floor assembly 12. A boarding ramp 24 is provided and is configured for mating attachment to the exterior of the hull and raft assembly 12. A ballast means 26 is provided and, is configured for attachment to the hull and floor assembly 12. The ballast means 26 typically is carried beneath the water level and therefore beneath the floor 16 of the hull and the floor assembly 12.

The hull and floor assembly includes a plurality of canopy support strut attachments 30. A plurality of attachments 38 are provided for retaining the boarding ramp 24 to the hull and floor assembly 12 in removable manner. The attachments 38 are provided on an exterior surface of the hull and floor assembly 12 as shown in FIG. 1. A plurality of floor section 24 attachments 36 are provided retained to the floor 16 of the hull and floor assembly 12.

A plurality of canopy attachments 32 are provided on the hull and floor assembly 12. The attachments 32 are spaced generally around a periphery of the hull and floor assembly 12 as defined by the upper tubular member 14.

A plurality of ballast means attachments 34 are provided in generally a spaced relationship around a periphery of the hull and floor assembly 12 and typically are embodied on the lower tubular member 15 or upon an outer or underwater surface of the raft floor 16. Additional ballast means attachments 34' may be provided attached to the underwater or outside surface of the floor 16. These attachments 34' are not spaced generally around the periphery of the hull and floor assembly 12 but rather are arranged in transverse fashion across the underwater surface of the floor 16 of the hull and floor assembly 12.

The canopy support strut 18 is typically an inflatable structure of generally tubular configuration. In the embodiment of FIG. 1, the support strut 18 includes a mounting flange 39 including attachments 41. The attachments 41 are configured for mating with the attachments 30 on the floor 16 of the hull and floor assembly 12 whereby the canopy support strut 18 is retained to the hull and floor assembly 12. The canopy support strut 18 typically is inflatable and is inflated employing a transfer hose 52 which can be of any suitable or conventional hosing in nature. The transfer hose 52 typically is attached to an inflatable portion of the hull and floor assembly 12 such as the upper tubular inflatable member 14. Typically, brass couplers 53 or the like are used to join the transfer hose 52 to the hull and floor assembly 12 and the inflatable canopy support strut 18. Other suitable or conventional hose fastening devices may be employed and such devices are well-known in the art. The inflatable canopy support strut 18 may include a canopy attachment 40 adjacent an upper end.

The canopy 20 typically is formed of a plurality of panels 44 which may be attached one to the next. The panels 44 can be pie-shaped segments or other suitable geometric configurations attached one to the next employing suitable or well-known means such as adhesive or vulcanization techniques, or stitching optionally reinforced with a webbing material. The canopy 20 includes a plurality of attachments 45 positioned and configured to mate with attachments 32 carried by the hull and floor assembly 12. While these attachments 45 are shown as ties in FIG. 1, these attachments could equally be webbing strips, slide-lip engagements snaps, or Velcro® fasteners. In preferred embodiments of the invention it may be desirable to include Velcro® strips 46 as shown in FIG. 1, snaps, or slide-lip engagements upon the canopy 20 and the hull and floor assembly 12 to assure against substantial movement of water between the canopy 20 and the hull and floor assembly 12 during operation of the modular liferaft. The attachment of Velcro® strips as shown in FIG. 1 can be accomplished employing adhesives and vulcanizable adhesives in well-known manner. Additional attachments 45' are provided on the canopy 20 and are configured and positioned for engaging the attachment 40 positioned at the upper end of the inflatable canopy support 18. This combination of attachments 40, 45' can be ties and grommets, quarter-turn fasteners, or other suitable or conventional releasable fastening means.

The floor sections 22, if required, are typically formed of a foam core 48 surrounded by a shell 49. The shell is typically configured to be sealed around edges thereof so as to preclude the movement of fluids such as seawater into the foam. While the foam may be of any suitable or conventional nature, the foam 48 in FIG. 1 is an open or closed cell polyurethane foam. The floor sections 22 include attachments 47 positioned and configured for engaging the attachment 36 embodied on the floor 16 of the hull and floor assembly 12. The floor sections 22 are thereby removably retained to the hull and floor assembly 12. Where the floor 16 of the hull and floor assembly 12 is a double paneled floor, floor sections 22 may not be required in forming the modular liferaft 10 of the invention.

The boarding ramp 24 typically is formed as an inflatable structure such as a one including plurality of inflation tubes 56 as shown in FIG. 1. A plurality of attachments 57 are provided and arranged and configured for engaging the attachments 38 embodied on the hull and floor assembly 12. These attachments 57, 38 can be of any suitable or conventional nature such as the ties and grommets depicted in FIG. 1 could may be equally be swiveling hooks and D-rings, quarter-turn fasteners, or slide-lip engagements.

The ballast means 26 typically is formed of a plurality of generally geometrically such as pie-shaped panels 60. Customarily the ballast means 26 is divided by a baffle 62 into a plurality of compartments. The baffle typically is attached by incorporation into seams between the panels 60 but may be equally attached employing suitable or conventional techniques such as but not limited to stitching, vulcanization, or adhesives to the ballast means 26. Often stitching joinders are reinforced by the use of a webbing or the like. The ballast means 26 includes a plurality of attachments 64, 64'. The attachments 64 are spaced in a generally regular manner about a periphery of the ballast means 26 and are spaced and configured for engaging the attachments 34 embodied on the periphery of the hull and floor assembly 12. The attachments 64' are generally configured and spaced to engage the attachments 34' on the floor 16 of the hull and floor assembly 12. While the attachments 64, 64', 34, 34' are shown as being grommets and ties or grommets and webbing in the embodiment of FIG. 1, the attachment points equally could be swivel hooks and D-rings or other suitable or conventional fasteners which may be disconnected for removal of the ballast means 26.

Indeed, all of the attachments 30, 32, 44, 34', 36, 38, 40, 41, 45, 45', 46, 47, 64, 64' as depicted in FIG. 1 may be, without limitation, suitable or conventional fastening devices capable of removably attaching the various components 18, 20, 22, 24, 26 of the modular liferaft to the hull and floor assembly 12. Such fasteners might include grommets and ties or grommets and webbing strips, quarter-turn fasteners, snaps, Velcro® brand fabric fasteners, D-rings and swivel hooks, slide-lip engagements and the like. Each, of course, must be selected for the particular task to be performed and must be capable of sustaining any loads impressed thereon by dint of operation of the modular liferaft 10 in a seagoing environment.

The ballast means 26, boarding ramp 24, support strut 18, canopy 20 and hull and floor assembly 12 typically are formed of a fabric material such as nylon coated on one or both surfaces with a rubberizing compound such as natural rubber, synthetic rubber, acrylonitrile-butadiene rubbers or so-called nitrile rubbers, chlorinated polyethylene, chlorosulfonated polyethylene styrenebutadiene, polychloroprene, vinyl chloride polymer and the like. It is intended that the term "coated fabric" as used herein be construed to refer to all fabrics coated with rubberizing elastomers finding utility in the formation of structure such as the modular liferaft 10 of the invention and useful for operation in a marine invention. In the embodiment of FIG. 1 the inflatable canopy support strut 18, hull and floor assembly 12, and inflatable boarding ramp 24, typically are formed of a polychloroprene coated nylon fabric while ballast means 26 and canopy 20 are formed from uncoated nylon fabric.

The floor sections 22 typically include an outer shell 49 formed from a fabric coated with a rubberizing compound. In the embodiment of FIG. 1, the fabric is a polyester and the coating compound is a polyvinyl chloride. Equally, the floor section outer shells 49 could be formed from other fabrics coated with rubberizing compounds, that is other coated fabrics.

It should be apparent in view of the foregoing that the modular liferaft 10 of the instant invention can be, therefore, inspected for defects, and upon the discovery of a defect within a particular component 12, 18, 20, 22, 24, 26, the component requiring service or replacement can be removed from the modular liferaft and replaced with a like or similar component while repairs are undertaken. Alternately should the hull and floor assembly 12 be damaged beyond repair, the remaining components 18, 20, 22, 24, 26 can be utilized with other hull and floor assemblies.

While a preferred embodiment of the invention is shown and described in detail, it should be apparent that various modifications may be made thereto without departing from the scope of the claims to follow.

What is claimed is:

1. A modular liferaft comprising:

a hull and floor assembly formed from at least two circumferential inflatable tubular members positioned vertically one atop the next and defining an outer periphery of the liferaft, and a floor attached to a lowermost of the tubular members and configured for preventing the entry of water into the liferaft between the floor and the lowermost tubular member, the liferaft including canopy support strut attachment points, floor pad attachment points, boarding ramp attachment points, canopy attachment points, and ballast means attachment points, a plurality of the ballast means attachment points being positioned circumferentially about the liferaft adjacent said outer periphery of the liferaft and including at least one ballast means attachment point positioned on an underwater surface of the floor interiorly of the outer periphery of the liferaft, the liferaft being formed from a fabric coated with a rubberizing compound and the attachment points being selected from a group consisting of grommets, ties, snaps, "D" rings, swivel clips, quarter-turn fasteners, webbing strips and slide-lip fasteners;

a canopy support strut including fasteners positioned and configured for attachment to the support strut attachment points, further including an upper canopy attachment point, and an air transfer device positioned and configured for transferring gaseous fluid from one of said tubular members of the raft to the canopy support strut;

a plurality of floor pads having a thermal insulating core covered by a coated fabric shell and including fastener means positioned and configured for engaging the floor pad attachment points associated with the liferaft;

a canopy including fastening means configured and positioned for engaging the canopy attachment points of the liferaft, the canopy being formed from a rubberized fabric and including an attachment point configured for engagement with the canopy support strut upper canopy attachment point;

an inflatable boarding ramp formed of a rubberized fabric and including a plurality of fasteners configured and positioned for engaging the boarding ramp attachment points embodied upon the liferaft; and a compartmentalized ballast means formed from panels of an uncoated fabric attached one to the next and including a longitudinal baffle defining pair of compartments therein, the ballast means having a plurality of fastener means along an outer periphery thereof and along the baffle positioned and configured for engaging the ballast means attachment points associated with the liferaft.

2. The modular liferaft of claim 1, the coated fabric shell of the floor pads being a vinyl coated polyester fabric, the transfer hose being a rubber hose having air transferring fittings thereon, the canopy being formed from a nylon fabric material coated with chlorosulfonated polyethylene, and the remaining of the elements of the liferaft being formed from a polychloroprene coated nylon material.

3. A modular liferaft comprising:

a hull and floor assembly including at least two circumferential tubular members positioned vertically one with respect to the other and a floor attached to a lowermost of the inflatable tubular members in a manner precluding the entry of liquid between the floor and the lowermost inflatable tubular member, the hull and floor assembly functioning to define a bottom and an outer circumference of the liferaft and including a plurality of attachment points configured to receive an inflatable canopy support strut, a canopy, a plurality of floor sections, a boarding ramp, and a ballast means, the canopy attachment points being adjacent to the uppermost tubular member and being configured and positioned around the outer circumference of the raft hull and floor assembly, a plurality of the ballast means attachment points being configured and positioned about said outer circumference of the raft hull and floor assembly adjacent the lowermost inflatable tubular member, and at least one of the ballast means attachment points being configured and positioned on an underwater surface of the floor interiorly of the outer circumference;

an inflatable canopy support strut having fasteners positioned and configured for detachably engaging the canopy attachment points embodied upon the hull and floor assembly and further including a means for transferring gaseous fluid from a tubular member of the hull and floor assembly to the inflatable support strut, and still further including a canopy attachment point positioned adjacent an upward end thereof;

a canopy including a plurality of fasteners configured for engaging the canopy attachment points embodied upon the hull and floor assembly and further including at least one central attachment point configured for detachably engaging the upwardly positioned attachment point of the inflatable canopy support strut;

a plurality of floor sections formed of an insulating core and an outer shell of a coated fabric and including fasteners positioned and configured for detachably engaging the floor section attachment points embodied on the hull and floor assembly;

a floatable boarding ramp formed of a coated fabric including fasteners positioned and configured for detachably engaging the boarding ramp attachment points positioned on an exterior surface of the hull and floor assembly; and a ballast means formed of a plurality of geometric segments of a coated fabric and including fasteners thereon at least some being oriented circumferentially and positioned and configured for detachably engaging the ballast means attachment points embodied on the hull and floor assembly and further including a baffle separating the ballast means into at least a pair chambers, the ballast including at least one fastener positioned and configured for detachably engaging the ballast means attachment point embodied on the underwater surface of the floor.

4. The modular liferaft of claim 3, the canopy being formed by a nylon fabric coated with chlorosulfonated polyethylene; the floor sections being formed of an open cell urethane foam having an outer shell therearound formed of a polyester fabric coated with polyvinyl chloride, the outer shell being configurated to prevent the movement of water into the open cell foam, the inflatable canopy support strut being formed by nylon fabric coated with neoprene polychloroprene; the means for transferring gaseous fluids being formed of a rubber hosing material including air transfer fittings; the hull and floor assembly being formed of a nylon fabric coated polychloroprene; the inflatable boarding ramp being formed of a nylon fabric coated with polychloroprene and the ballast means being formed of a nylon fabric.

5. The modular liferaft of claim 4, the attachment points being selected from a group consisting of grommets, snaps, quarter-turn fasteners, "D" rings and swivel hooks, slide-lip engagements, fabric fasteners, webbing straps, ties, and combinations thereof.

* * * * *